US007606512B2

(12) United States Patent
Ukai et al.

(10) Patent No.: US 7,606,512 B2
(45) Date of Patent: Oct. 20, 2009

(54) IMAGE FORMING DEVICE WITH COVER PROTRUSIONS

(75) Inventors: Masamitsu Ukai, Aichi-ken (JP); Atsuo Hirose, Aichi-ken (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 142 days.

(21) Appl. No.: 11/856,812

(22) Filed: Sep. 18, 2007

(65) Prior Publication Data

US 2008/0124118 A1 May 29, 2008

(30) Foreign Application Priority Data

Nov. 27, 2006 (JP) ..... 2006-318677

(51) Int. Cl.
*G03G 15/00* (2006.01)

(52) U.S. Cl. ..... 399/110

(58) Field of Classification Search ..... 399/110, 399/107

See application file for complete search history.

(56) References Cited

U.S. PATENT DOCUMENTS

| | | | | |
|---|---|---|---|---|
| 6,535,705 | B2 * | 3/2003 | Asakura et al. | 399/119 |
| 7,020,419 | B2 * | 3/2006 | Tsuruya et al. | 399/227 |
| 2006/0140669 | A1 * | 6/2006 | Sato | 399/110 |

FOREIGN PATENT DOCUMENTS

| | | | |
|---|---|---|---|
| JP | 5-35069 | A2 | 2/1993 |
| JP | 11-258908 | A | 9/1999 |
| JP | 2001-150777 | A | 6/2001 |
| JP | 2005-77615 | A | 3/2005 |
| JP | 2006-39596 | A | 2/2006 |
| JP | 2006-267402 | A | 10/2006 |

OTHER PUBLICATIONS

Computer Translation of JP2006-039596A.*

* cited by examiner

*Primary Examiner*—Quana M Grainger
(74) *Attorney, Agent, or Firm*—Banner & Witcoff, Ltd.

(57) ABSTRACT

An image forming apparatus, such as a printer, may have a horizontally-loaded drawer containing, for example, a toner cartridge or an image forming unit having toner. The apparatus may have an opening through which the drawer is inserted, and a cover over the opening. The cover may include two or more protrusions to assist in forcing the drawer into place as the cover is closed. The cover may include a first protrusion that is closer to the cover's hinge, and a second that is farther from the hinge than the first. The first protrusion may also be longer, extending further from the cover, than the second, so that during the closing operation, the first protrusion makes contact with the drawer before the second. The points of contact on the drawer may be angled and/or curved such that the force exerted by the protrusions directs the drawer horizontally and, if desired, downwardly towards an operating position. A protrusion may be aligned such that, when the cover is in the closed position, the protrusion is offset from a point of contact on the drawer, and exerts no horizontal force on the drawer.

10 Claims, 6 Drawing Sheets

IMAGE FORMING DEVICE WITH COVER PROTRUSIONS

CROSS REFERENCE TO RELATED APPLICATION

This application claims priority from Japanese Patent Application No. 2006-318677, filed on Nov. 27, 2006, the entire subject matter of which is incorporated herein by reference.

TECHNICAL FIELD

Aspects described herein relate to an image forming apparatus, such as a laser printer.

BACKGROUND

Electrophotographic image forming apparatuses such as laser printers are generally configured to form an image on a recording medium such as a sheet of paper or a transparency (hereinafter referred to as a recording sheet) by transferring a developing agent or toner. However, toner is consumable and needs replenishing regularly.

In some of the image forming apparatuses, a process cartridge (e.g., an image forming unit), which includes a toner storing portion configured to store toner therein, is disposed in an apparatus body so as to be vertically removable. When toner decreases, the process cartridge is replaced with a new one.

When a process cartridge is installed in the apparatus body, the process cartridge is inserted, from above, down into the apparatus body and a cover is closed. A lever member is configured to mechanically move along with a closing movement of the cover. The lever member presses the process cartridge downward and moves it to its normal position.

SUMMARY

Aspects described herein may provide an image forming apparatus configured to move an image forming unit, which is horizontally and movably coupled to the image forming apparatus, to a normal position in association with a closing operation of a cover.

BRIEF DESCRIPTION OF THE DRAWINGS

Features herein will be described in detail with reference to the following figures in which like elements are labeled with like numbers and in which.

DETAILED DESCRIPTION

The following section is made with reference to the accompanying drawings.

The image forming apparatus features described herein may be applied to an electrophotographic image forming apparatus, such as a laser printer. It will be appreciated that aspects of the invention apply to other types of image forming apparatuses as well.

For purposes herein, aspects of the invention are shown in relation to an image carrier and developer carrier. In various aspects, the image carrier may include a photosensitive drum, photosensitive belt, or the combination of one of a photosensitive drum or belt and an intermediate transfer drum or belt. Further, the developer carrier may include a developer roller or other systems for conveying developer to the image carrier.

It is noted that various connections are set forth between elements in the following description. It is noted that these connections in general and, unless specified otherwise, may be direct or indirect and that this specification is not intended to be limiting in this respect.

An appearance of a laser printer 1 will be now described with reference to FIGS. 1-5.

Figure 1:
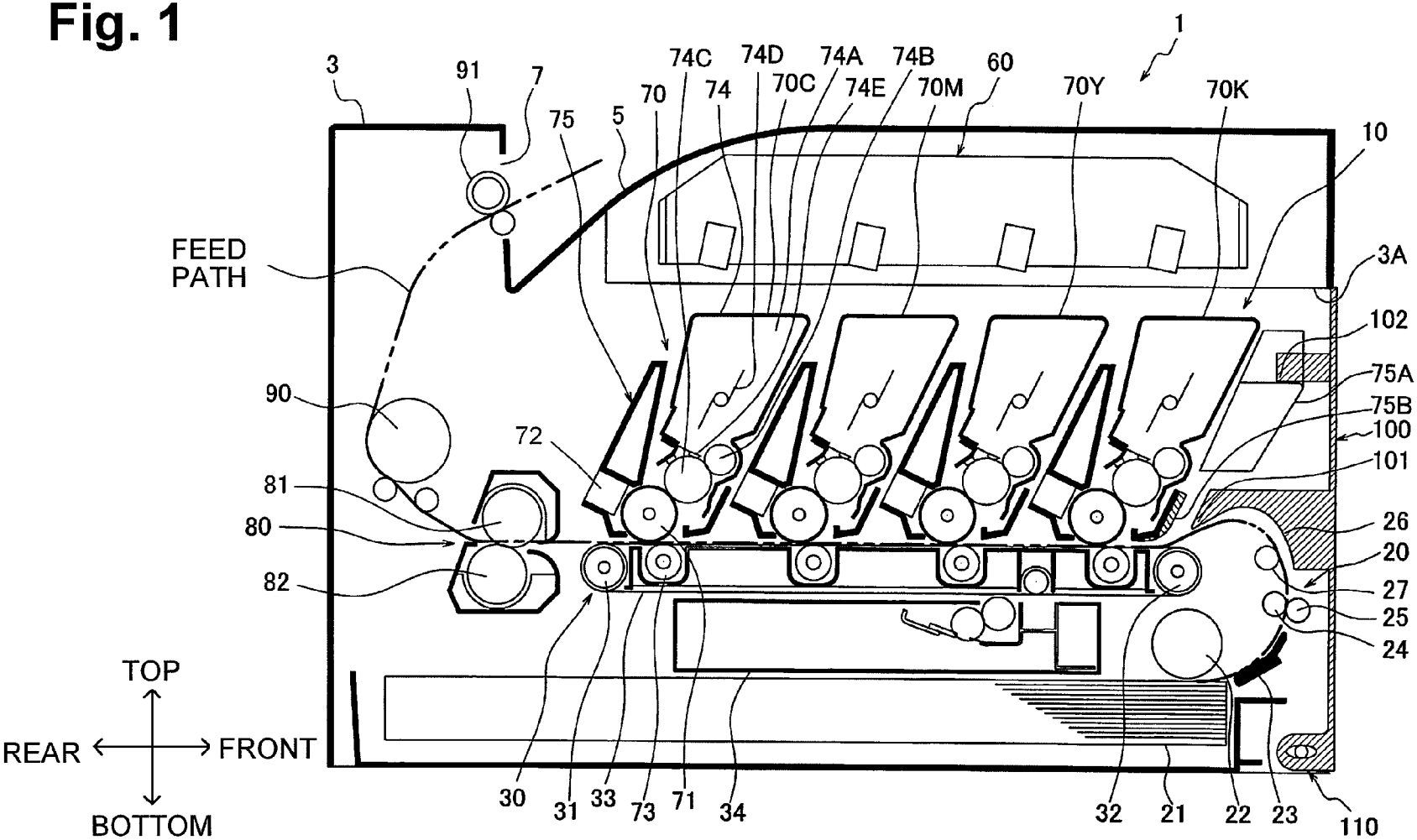
FIG. 1 is a side sectional view showing a main part of a laser printer according to an illustrative embodiment.

An upper side of FIG. 1 is referred to as the top of a laser printer 1, and the right side of FIG. 1 is referred to as the front side of the laser printer 1. In the following description, top, bottom, rear, and front of objects in the laser printer 1 are used with reference to the arrows in FIG. 1.

A housing 3 provides for an apparatus body of the laser printer 1. A sheet discharge tray 5 may be provided on the top of the housing 3. Printed recording sheets such as plain paper or transparency may be ejected from the housing 3 and received on the sheet discharge tray 5.

Figure 2:
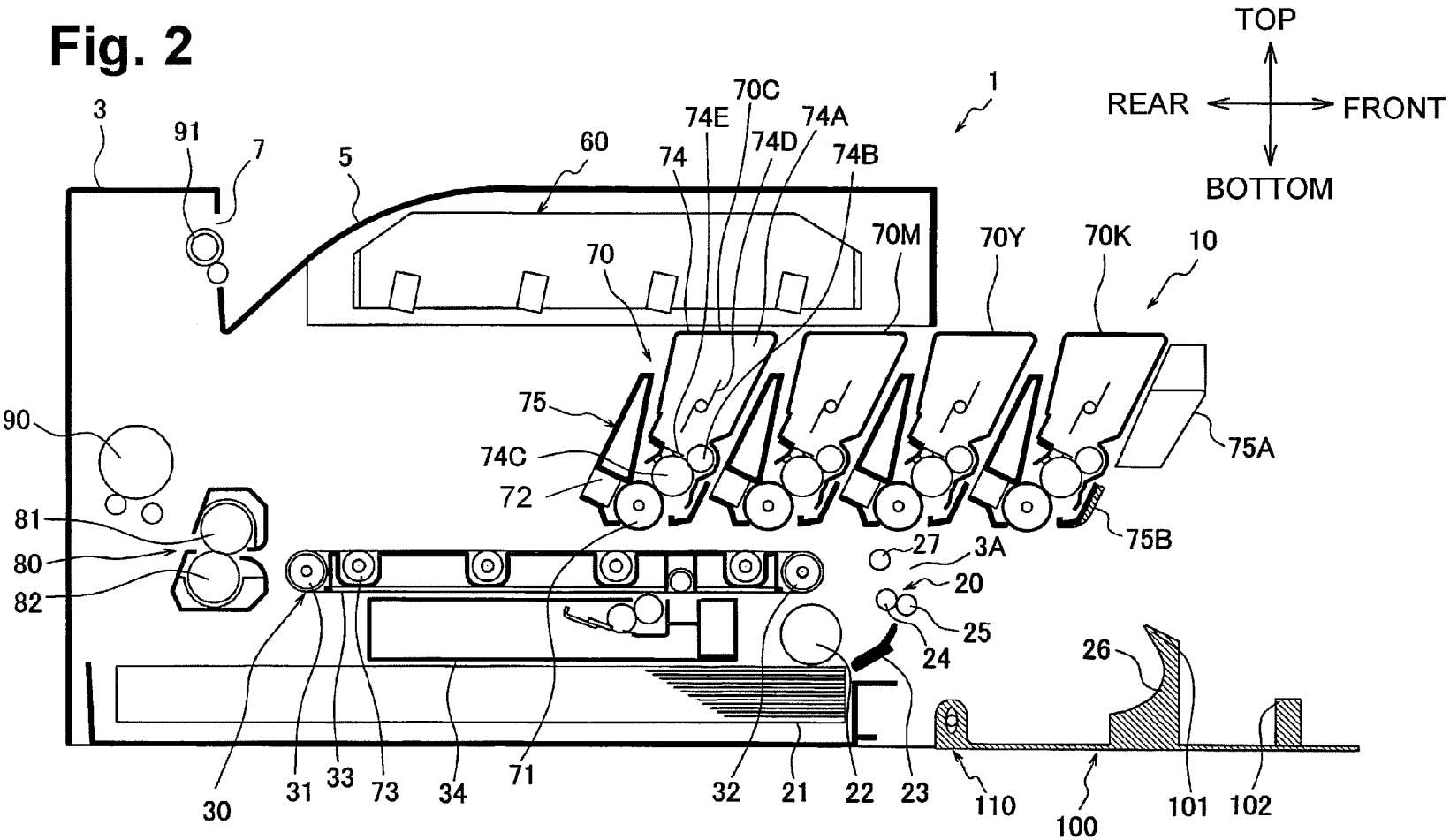
FIG. 2 is a side sectional view of a drawer unit being attached to or removed from the laser printer.
Figure 3:
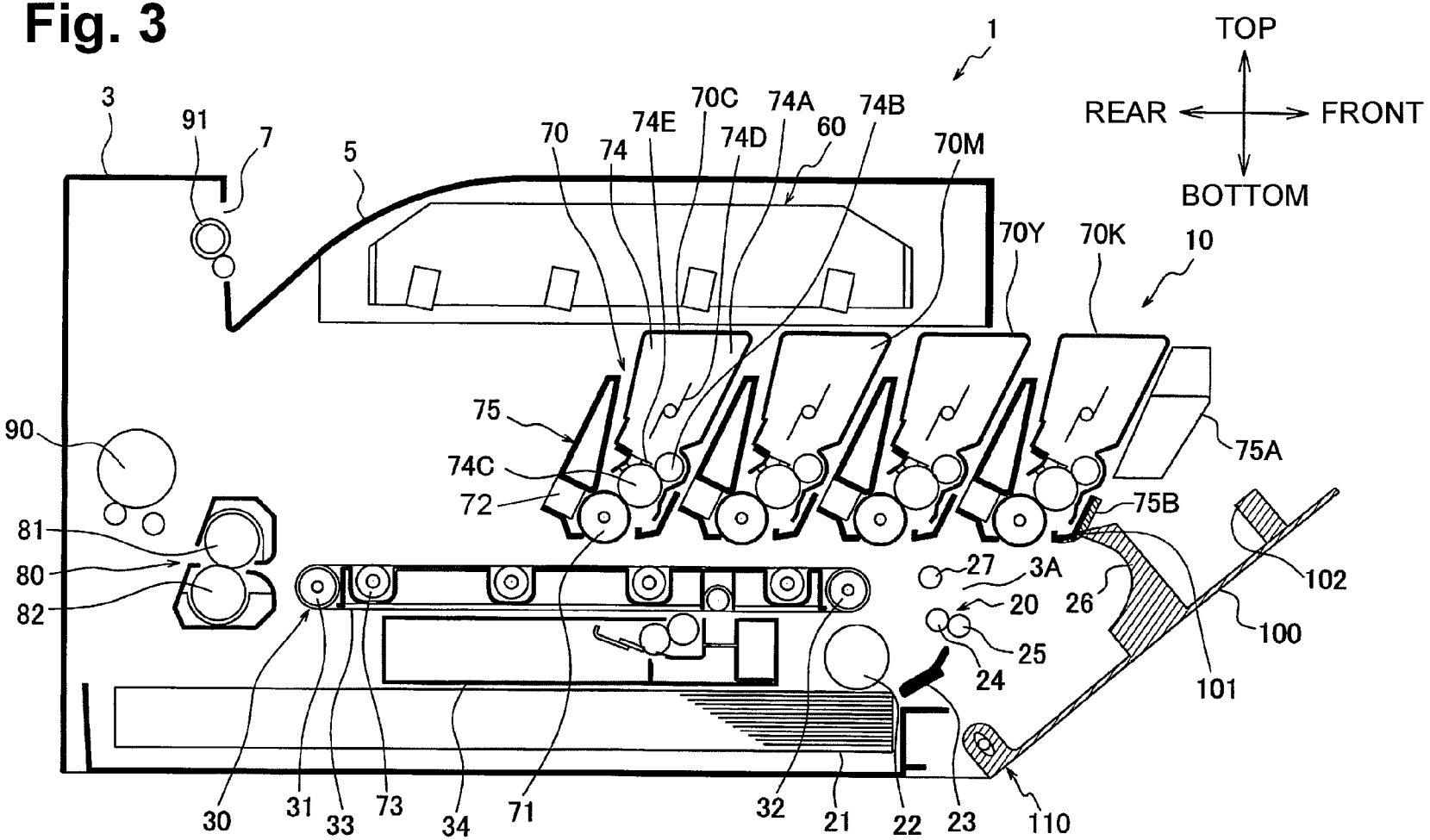
FIG. 3 is a side sectional view of a drawer unit being attached to or removed from the laser printer.
Figure 4:
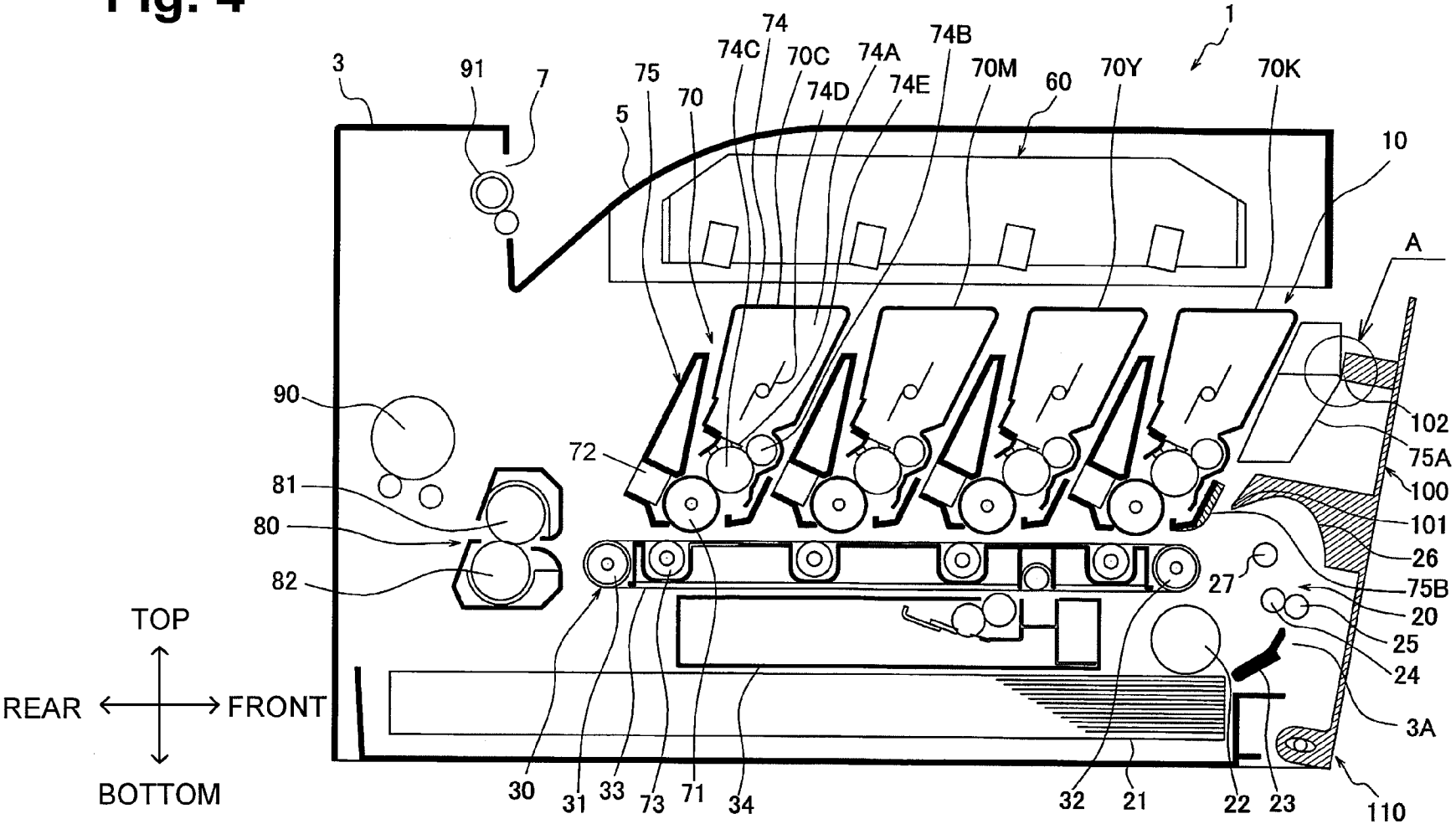
FIG. 4 is a side sectional view of a drawer unit being attached to or removed from the laser printer.

As shown in FIGS. 2-4, an opening 3A may be provided on the front side of the housing 3. The opening 3A may be opened and closed by a front cover 100 pivotally coupled to a lower end of the housing 3 via a hinge mechanism 110 as shown in FIG. 1.

The hinge mechanism 110 may be provided with slots formed on the front cover 100 and the housing 3, pins inserted into the slots, and substantially L-shaped spring plates (not shown) that draw the pins to the housing 3 or the front cover 100. The slots respectively formed on the housing 3 and the front cover 100 may be disposed substantially perpendicularly to each other when the front cover 100 is closed as shown in FIG. 1.

A frame member (not shown) made of metal or resin may be provided in the housing 3, and a drawer unit 70 and a fixing unit 80 may be coupled to the frame member in a detachable manner.

An internal structure of the laser printer 1 will be described.

The laser printer 1 may include an image forming portion 10, a feeder portion 20, and a feed mechanism 30. The image forming portion 10 functions as an image forming device that is configured to form an image onto a recording sheet. The feeder portion 20 may function as a part of a feeding device configured to supply a recording sheet to the image forming portion 10. The feed mechanism 30 may be configured to feed a recording sheet to four image forming units 70K, 70Y, 70M, 70C that make up the image forming portion 10.

After an image has been recorded on the recording sheet, an intermediate feed roller 90 and an ejection chute (not shown) may take the recording sheet and feed it upwards towards ejection rollers 91. The ejection rollers 91 may cause the sheet to be ejected from the ejection portion 7 and onto the ejection tray 5.

The feeder portion 20 may include a sheet supply tray 21, a sheet supply roller 22, and a separation pad 23. The sheet supply tray 21 may be disposed in the lowermost part of the housing 3, and may be configured to hold a stack of recording sheets. The sheet supply roller 22 may be disposed at an upper front end of the sheet supply tray 21, and may be configured to supply or feed a recording sheet from the sheet supply tray 21 to the image forming portion 10. The separation pad 23 may be disposed downstream of the sheet supply roller 22 in the direction of the roller's rotation, and may be configured to apply a resistance to separate a topmost sheet from the stack of recording sheets in the sheet supply tray 21.

The recording sheet stored in the sheet supply tray 21 makes a u-turn (e.g., is flipped over) at the front side of the housing 3, and fed to the image forming portion 10, which may be centrally disposed in the housing 3. A feed roller 24 may be disposed where the u-turn is made, and may be located along a sheet feed path extending from the sheet supply tray 21 to the image forming portion 10. The feed roller 24 may be configured to give a feeding force to a recording sheet being fed to the image forming portion 10 while the sheet makes its u-turn.

A pressure roller 25 may be disposed facing the feed roller 24. The pressure roller 25 may be configured to press a recording sheet toward the feed roller 24. The pressure roller 25 may be urged toward the feed roller 24 by an elastic member such as a coil spring (not shown).

A feed chute 26 is disposed downstream of the feed roller 24 with respect to a direction where a recording sheet is fed (hereinafter referred to as a sheet feeding direction). The feed chute 26 functions as a guiding device that guides a recording sheet by contact with an outer surface of the recording sheet being fed in a u-shape. A pressure roller 27 is disposed on an inner side of the feed path bent in a u-shape. The pressure roller 27 is configured to press the recording sheet being fed toward the feed chute 26.

In one example embodiment, the feed chute 26 may be integrally formed with the front cover 100 while the pressure roller 27, the feed roller 24 and the pressure roller 25 are coupled to the housing 3.

The feed mechanism 30 may include a drive roller 31, a driven roller 32, a conveyor belt 33, and a belt cleaner 34. The drive roller 31 may be configured to rotate along with an operation in the image forming portion 10. The driven roller 32 may be spaced away from the drive roller 31 and may be configured to rotate. The conveyor belt 33 may be stretched between the drive roller 31 and the driven roller 32. The belt cleaner 34 may be configured to remove toner adhering on a surface of the conveyor belt 33.

As the conveyor belt 33 rotates with a recording sheet placed thereon, the recording sheet supplied from the sheet supply tray 21 can be fed to the four image forming units 70K, 70Y, 70M, and 70C successively.

The image forming portion 10 may be a direct-tandem type, where color printing is possible, and may include a scanner unit 60, the four image forming units 70K, 70Y, 70M, and 70C, and a fixing unit 80.

The four image forming units 70K, 70Y, 70M, and 70C may correspond to four color types of toner, such as black, yellow, magenta, and cyan, respectively, and may be arranged in a line along a sheet feeding direction.

The scanner unit 60 may be disposed in an upper portion of the housing 3, and may be configured to form electrostatic latent images on corresponding surfaces of photosensitive drums (image carriers) 71 disposed in the four image forming units 70K, 70Y, 70M, and 70C, respectively. The scanner unit 60 may include a laser light source, a polygon mirror, fθ lens and reflecting mirrors.

A laser beam emitted from the laser light source, based on image data, may be deflected by the polygon mirror, pass through the fθ lenses, and be folded by the reflecting mirror to be directed to a surface of the photosensitive drum 71, on which an electrical latent image is formed.

A drawer unit 70 will be described.

The drawer unit 70 may include the four image forming units 70K, 70Y, 70M, and 70C that form the image forming unit 10, and may include a slider casing 75 that stores the cartridges 70K, 70Y, 70M, and 70C therein. The slider casing 75 may be coupled to the housing 3 so as to move in a horizontal direction, i.e., in a front-rear direction of the laser printer 1 in this embodiment, while being supported by rails (not shown) disposed in the frame member of the housing 3.

The four image forming units 70K, 70Y, 70M, and 70C may be part of a drawer unit 70 that is integrally formed with the slider casing 75, and the drawer unit 70 may be detachably attached to the housing 3. As shown in FIGS. 2-4, the drawer unit 70 may be attached to and removed from the housing 3 via the opening 3A in the front-rear direction when the front cover 100 is open. The structure and operation to attach and remove the drawer unit 70 will be described later.

The four image forming units 70K, 70Y, 70M, and 70C may be identical in structure, but with different colors of toner. Thus, in the following description, the structure of the image forming units will be described by using the image forming unit 70C as an example.

As shown in FIG. 1, the image forming unit 70C may include a photosensitive drum 71, a charger 72, and an image forming unit 74 inside. A transfer roller 73 may be rotatably supported by the frame member so as to face the photosensitive drum 71 on the opposing side of the conveyor belt 33.

The photosensitive drum 71 may be configured to carry an image that is to be transferred onto a recording sheet. The photosensitive drum 71 may be cylindrically shaped, and its outermost layer may be a positively charged photosensitive layer made of polycarbonate. The charger 72 may be configured to charge the surface of the photosensitive drum 71. The charger 72 may be disposed away from the photosensitive drum 71, so as to face the photosensitive drum 71 diagonally rearward from above.

The charger 72 according to this illustrative embodiment may be a scorotron charger that charges the surface of the photosensitive drum 71 substantially uniformly and positively by corona discharge from a charging wire made of tungsten or the like.

The transfer roller 73 may be disposed to face the photosensitive drum 71, and may be configured to rotate along with the rotation of the conveyor belt 33. Also, the transfer roller 73 may apply an electrical charge, having a polarity (a negative charge in this illustrative embodiment) opposite to an electrical charge of the photosensitive drum 71, to the recording sheet from the bottom side (opposite the print surface) of the recording sheet as it passes through the photosensitive drum 71.

A toner storing portion 74 may include a toner chamber 74A, a toner supply roller 74B, a developing roller (developer carrier) 74C, and an agitator 74D. Toner may be stored in the toner chamber 74A. The toner supply roller 74B and the developer carrier 74C may be configured to supply toner to the photosensitive drum 71. The agitator 74D may be configured to agitate toner stored in the toner chamber 74A.

Toner stored in the toner chamber 74A may be supplied to the developer carrier 74C along with the rotation of the toner supply roller 74B. The toner supplied to the developer carrier 74C may be carried on a surface of the developer carrier 74C, regulated to a uniform thickness by a layer thickness regulating blade 74E, and then supplied to the surface of the photosensitive drum 71 that is exposed to light by the scanner unit 60.

The fixing unit 80 may be disposed rearward from the photosensitive drum 71 with respect to the sheet feeding direction, and may be configured to melt toner transferred onto the recording sheet by heat and fix it to the recording sheet. The fixing unit 80 may be removable from the body frame.

The fixing unit 80 may include a heat roller 81 and a pressure roller 82. The heat roller 81 may be disposed to face the print surface of a recording sheet, and may be configured to give a feeding force to a recording sheet while heating the toner on the recording sheet. The pressure roller 82 may be disposed to face the heat roller 81 from below, and may be configured to press against the heat roller 81.

The heat roller 81 may be rotated in synchronization with the developer carrier 74C and the conveyor belt 33. The pressure roller 82 may receive a rotational force from the heat roller 81 via a recording sheet that is sandwiched between the rollers 81, 82.

In the image forming portion 10, an image may be formed on a recording sheet as follows.

As the photosensitive drum 71 rotates, the surface of the photosensitive drum 71 may be charged uniformly and positively by the charger 72, and then exposed to a laser beam emitted from the scanner portion 60 at high speed scanning. In this manner, an electrostatic latent image corresponding to the image to be formed on a recording sheet may be formed on the surface of the photosensitive drum 71.

With the rotation of the developer carrier 74C, toner carried on the developer carrier 74C and positively charged makes contact with the photosensitive drum 71, and is supplied to the electrostatic latent image formed on the surface of the photosensitive drum 71. The toner may be supplied to the uniformly and positively charged surface of the photosensitive drum 71 at a portion where the potential has become low due to exposure to the laser beam. As a result, the latent image on the photosensitive drum 71 becomes visible and a reversal takes place. Thus, a toner image may be formed on the photosensitive drum 71.

The toner image carried on the photosensitive drum 71 may be transferred onto the recording sheet by a transfer bias applied to the transfer roller 73. Then, the recording sheet may be fed to the fixing unit 80 and heated by the fixing unit 80 so that the toner transferred onto the recording sheet as the toner image is fixed on the recording sheet, and image formation is finished.

Installation and removal of the drawer unit 70 from the laser printer 1 will be described below.

When the drawer unit 70 is installed in a normal position, as shown in FIG. 1, the photosensitive drum 71 may be disposed in proximity to the conveyor belt 33. The drawer unit 70 may be fixed in this position, such that the drawer unit 70 cannot be moved in the front-rear direction with respect to the frame member of the housing 3. The normal position is a position that causes the image forming units 70C, 70M, 70Y, 70K to form an image on a recording sheet, that is, the position that causes the image forming units 70C, 70M, 70Y, 70K to print.

When the drawer unit 70 is to be removed from the housing 3, the front cover 100 may be opened, and a handle portion 75A provided in the slider casing 75 may be grasped to pull the drawer unit 70 toward the opening 3A.

The slider casing 70 of the drawer unit 70 moves on inclined surfaces (not shown) of rails formed on longitudinal ends thereof, the drawer unit 70 entirely moves upward away from the conveyor belt 33 as shown in FIGS. 2-4, and rises on the rails extending in the front-rear direction.

When the drawer unit 70 is pulled toward the opening 3A with the drawer unit 70 on the rails extending in the front-rear direction, the drawer unit 70 may be removed from the housing 3.

The front cover 100 may be provided with a first pressing portion 101 and a second pressing portion 102 on a side facing the drawer unit 70, and may be protrusions or projections extending from the cover 100. The pressing portions 101, 102 may be configured to press the drawer unit 70 to its normal position (toward the inside from the opening 3A) when the drawer unit 70 is installed in the housing 3.

The first pressing portion 101 may be disposed closer to the hinge mechanism 110 than the second pressing portion 102. As shown in FIG. 3, as the front cover 100 is being closed, the first pressing portion 101 may press against a front end of the slider casing 75 of the drawer unit 70, forcing the drawer unit 70 toward the normal position. The front end of the slider casing 75 may extend in a width direction of the slider casing 75 of the drawer unit 70, or a horizontal direction substantially perpendicular to a direction in which the drawer unit 70 is moved.

Specifically, the first pressing portion 101 may be disposed in an end of a tip of the feed chute 26, which is shifted from a guide surface that contacts and guides a recording sheet. As shown in FIG. 1, a feed chute 75B may be disposed on the front of the slider casing 75 to face the guide surface of the feed chute 26 thereby defining the feed path. In other words, the feed chute 75B may be shifted in the width direction from a position where the drawer unit 70 contacts the first pressing portion 101.

The second pressing portion 102 may be disposed in a position that is close to an upper end of the front cover 100 and away from the hinge mechanism 110 further than the first pressing portion 101. As shown in FIG. 4, the second pressing portion 102 may press the drawer unit 70 toward the normal position by pressing against the handle portion 75A of the slider casing 75. The second pressing portion 102 may be formed as a protrusion protruding toward the drawer unit 70.

As illustrated, when the front cover 100 is being closed, the first pressing portion 101 first contacts the drawer unit 70 in advance of the second pressing portion 102 and presses the drawer unit 70 toward the normal position, and then the second pressing portion 102 presses the drawer unit 70 toward the normal position.

Figure 5:
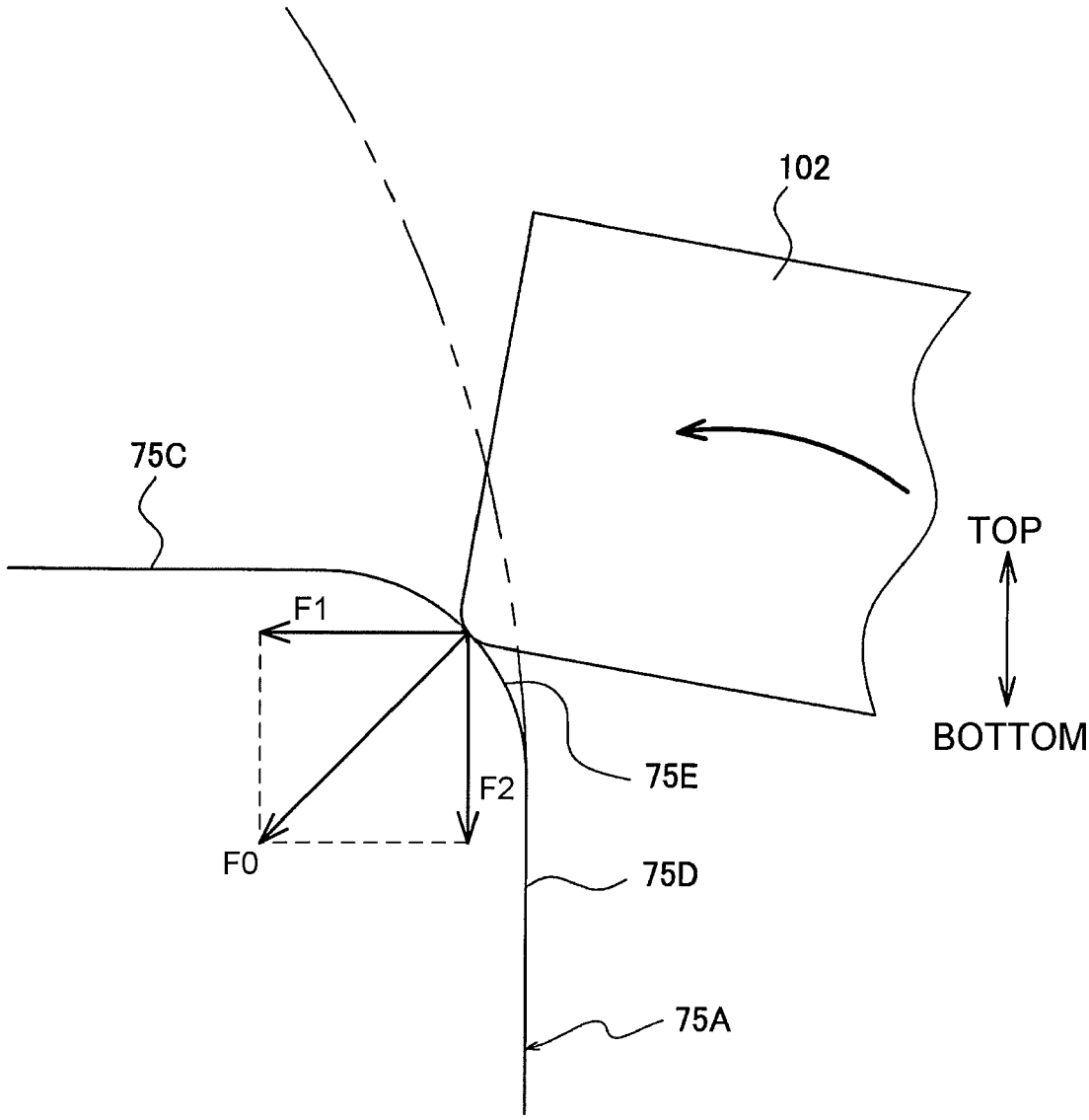
FIG. 5 is an enlarged view of a part enclosed by A of FIG. 4.

As shown in FIG. 5, the handle portion 75A may include a first planar surface 75C that is substantially parallel to the moving direction of the drawer unit 70, a second planar surface 75D that faces the front cover 100 and extends in a direction substantially perpendicular to the first planar surface 75C, and an inclined surface 75E that is rounded so as to smoothly connect the first planar surface 75C and the second planar surface 75D. The tip of the second pressing portion 102 may contact the inclined surface 75E and press the drawer unit 70.

When the drawer unit 70 is installed in the housing 3, a user may first press the drawer unit 70 more than half way toward the normal direction as shown in FIG. 2, i.e. toward the left in FIG. 2. Then, as the user is closing the front cover 100, the first pressing portion 101 may first contact the feed chute 75B of the slider casing 75 as shown in FIG. 3, and press the drawer unit 7 closer to the normal position.

As the user is further closing the front cover 100, the second pressing portion 102 may contact the handle portion 75A as shown in FIG. 4, and press the drawer unit 70 further closer to the normal position. At this time, a tip of the second pressing portion 102 may make contact with the inclined surface 75E and press the drawer unit 70. Thus, as shown in FIG. 5, the drawer unit 70 receives a force F1 directed toward the normal position and a force F2 directed downward (toward the feed mechanism 30).

When the drawer unit 70 is moved to inclined surfaces of the rails formed on longitudinal ends thereof, it may be pressed downward with the force F2 in proximity of the feed mechanism 30 or the conveyor belt 33, and installed in the normal position.

When the drawer unit 70 is installed in the normal position, the tip of the second pressing portion 102 may be located inside the housing 3 offset from the second planar surface 75D as shown in FIG. 1 and at a position shifted in a direction perpendicular to the first planar surface 75C, e.g., upward in this embodiment.

An image forming apparatus configured such that a process cartridge is disposed under a top cover of a housing is known. In this type of image forming apparatus, when the process cartridge is inserted into the housing from the top, the process cartridge moves down, under its own weight, to the normal position set in a lower position in the housing. Thus, as the top cover is closed to install the process cartridge into the housing, there is no need to strongly press the process cartridge down at an earlier stage. The image forming apparatus may be configured in any way as long as the process cartridge is pressed only at a final stage when the top cover is nearly closed.

However, the laser printer 1 is configured such that the image forming units 70C, 70M, 70Y, 70K are inserted into and removed from the housing 3 horizontally in the front-rear direction. When the image forming units 70C, 70M, 70Y, 70K are first inserted into the housing 3, the image forming units 70C, 70M, 70Y, 70K are not necessarily subjected to any force to move under their own weight.

Thus, to move the image forming units 70C, 70M, 70Y, 70K mechanically in connection with the closing movement of the front cover 100, there is a need to press the image forming units 70C, 70M, 70Y, 70K toward the normal position continuously from the early stage to the final stage of the closing operation of the front cover 100.

In this embodiment, as described above, the first pressing portion 101 presses the drawer unit 70 toward the normal position in an early stage of the closing operation of the front cover 100, while the second pressing portion 102 presses the drawer unit 70 toward the normal position in a final stage of the closing operation of the front cover 100. Thus, the drawer unit 70 can be moved toward the normal position continuously from the first stage to the final stage of the closing operation of the front cover 100.

If the drawer unit 70 is pressed with only one of the first and second pressing portions 101, 102 continuously from the first stage to the final stage of the closing operation of the front cover 100, the pressing portion may be worn out early.

On the contrary, in this embodiment, the drawer unit 70 may be pressed with both of the first and second pressing portions 101, 102 continuously from the first stage to the final stage of the closing operation of the front cover 100. Thus, the first and second pressing portions 101, 102 will suffer less wear.

Alternatively, the drawer unit 70 may be pressed only with the second pressing portion 102 continuously from the first stage to the final stage of the closing movement. In this alternative, the second pressing portion 102 may contact the drawer unit 70 upon the first stage of the closing movement, that is, when the front cover 100 is beginning to close.

The second pressing portion 102 may be disposed at the end of the front cover 100 away from the hinge mechanism 110, and the front cover 100 may be pivotally coupled to the housing 3. When the front cover 100 is fully opened, a distance from the second pressing portion 102 to the drawer unit 70 is greater than a distance from the first pressing portion 101 to the drawer unit 70. In other words, the second pressing portion 102 may be shorter in length than the first pressing portion 101.

Thus, for configurations in which the drawer unit 70 is pressed only by the second pressing portion 102 during the closing operation of the front cover 100, the second pressing portion 102 should protrude more, and will increase in size.

However, if the second pressing portion 102 increases in size, it obstructs the removal of the drawer unit 70 even when the front cover 100 is fully opened, and it may be difficult to remove the drawer unit 70 easily.

When the front cover 100 is completely closed, the second pressing portion 102 may be accommodated in the housing 3. However, if the second pressing portion 102 increases in size, it may be very hard to spare space for the increased second pressing portion 102 in the housing 3.

As described above, when the cover 100 is fully open, the top end of the first pressing portion 101 is closer to the drawer unit 70 than the top end of the second pressing portion 102. Thus, the first pressing portion 101 can be brought in contact with the drawer unit 70 from the first stage of the closing operation of the front cover 100 without increasing the size of the first pressing portion 101.

As a result, as long as the arrangement is such that the first pressing portion 101 contacts the drawer unit 70 in advance of the second pressing portion 102 when the front cover 100 is being closed as described above, there is no need to increase the size of the second pressing portion 102. With this arrangement, the drawer unit 70 can be kept pressed continuously from the first stage to the final stage of the closing operation of the front cover 100, and space for the second pressing portion 102 can be spared in the housing 3 relatively easily.

Figure 6:
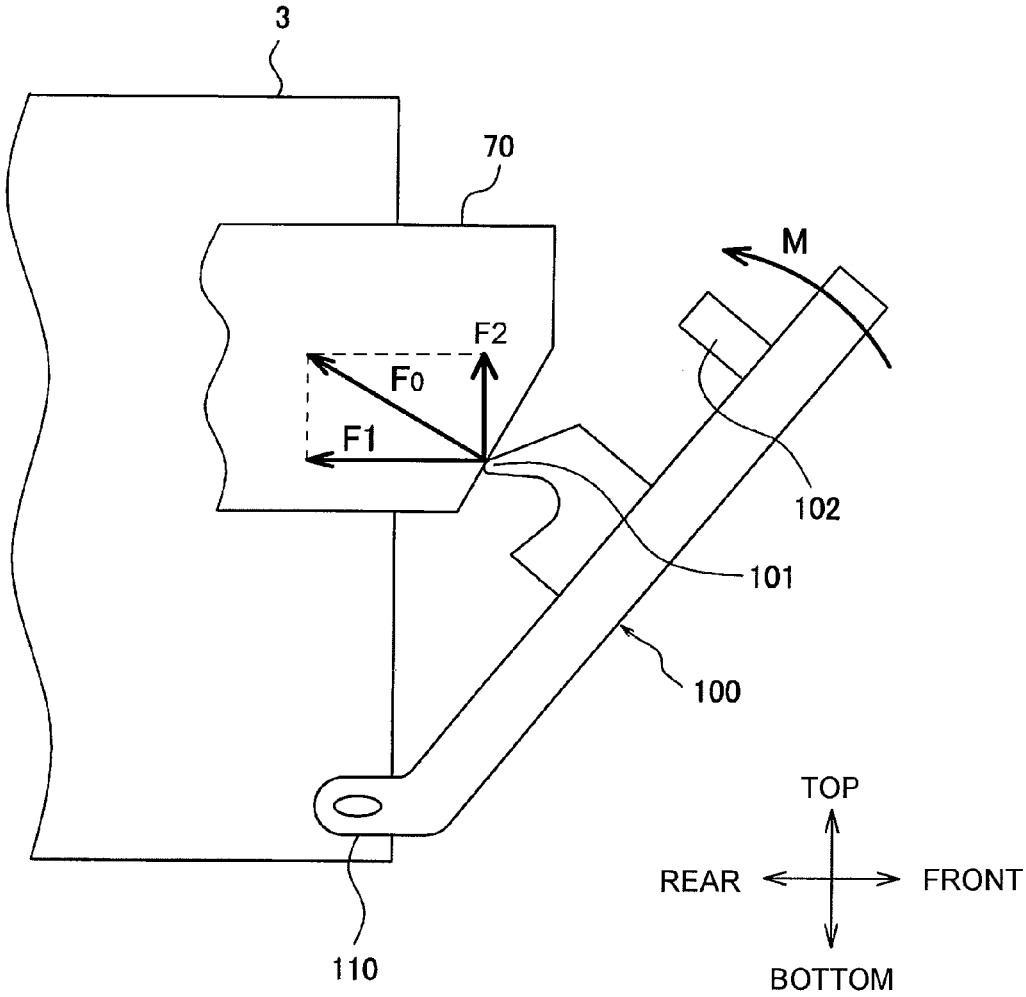
FIG. 6 illustrates force acting on a cover and the drawer unit.

FIG. 6 shows forces exerted on the front cover 100 and the drawer unit 70. M indicates a moment that causes the front cover 100 to close. F0 indicates a force that the front cover 100 presses the drawer unit 70. F1 indicates a component of the force F0 applied in a horizontal direction substantially parallel to the moving direction of the drawer unit 70. F2 indicates a component of the force F0 applied in a vertical direction. As is apparent from FIG. 6, the component F1 may be smaller at an earlier stage of closing movement of the front cover 100.

According to the principle of leverage, the force F0 may be greater in a position closer to the hinge mechanism 110. Thus, if the drawer unit 70 is pressed with the first pressing portion 101, the component F1 that presses the drawer unit 70 increases.

As a result, when the first pressing portion 101 disposed near the hinge mechanism 110 presses the drawer unit 70 during the first stage of the closing operation of the front cover 100, the drawer unit 70 can be pressed toward the normal position with a greater force, and without a need to increase the force exerted on the front cover 100.

Accordingly, the drawer unit 70 can be pressed toward the normal position while the front cover 100 is closed with a relatively small force such as to prevent wear of the first and second pressing portions 101, 102 and to not obstruct removability of the drawer unit 70.

If the arrangement is such that the second pressing portion 102 presses the drawer unit 70 at the second planar surface 75D, the protrusion forming the second pressing portion 102 contacts the second planar surface 75D even when the opening 3A is closed by the front cover 100. Thus, the laser printer 1 increases in length or a dimension in the front-rear direction at least by a dimension of the protrusion.

However, as described above, when the front cover 100 is closed, the tip of the second pressing portion 102 is located inside the housing 3 and above the second planar surface 75D, as shown in FIG. 1, e.g., at a position shifted in a direction perpendicular to the first planar surface 75C. The protrusion forming the second pressing portion 102 may be located inside further from the second planar surface 75D.

Thus, the size front-to-back of laser printer 1 can be reduced, while the drawer unit 70 can still be pressed toward the normal position.

As illustrated, as the drawer unit 70 includes the four image forming units 70K, 70Y, 70M, 70C, the drawer unit 70 may be heavy compared with a drawer unit for a monochrome laser printer having only one image forming unit. However, in the laser printer 1, the drawer unit 70 can be moved toward the normal position while the front cover 100 is closed with a relatively small force. This arrangement is effective especially when applied to the color laser printer 1 in which the drawer unit 70 becomes relatively heavy.

Figure 7:
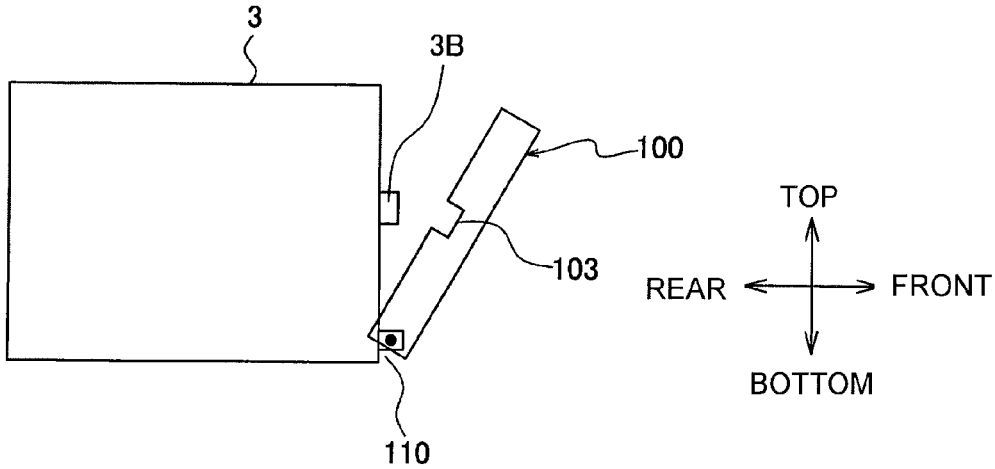
FIG. 7 is a schematic view showing feature of a second embodiment.

A second embodiment will be described with reference to FIG. 7.

In the second embodiment, a recessed portion 103 may be formed on the front cover 100 and a protrusion 3B may be formed on the housing 3. When the front cover 100 is closed to the housing 3, the recessed portion 103 may be engaged with the protrusion 3B. Alternatively, the recessed portion 103 may be formed on the housing 3 and the protruding portion 3B may be formed on the front cover 100.

With this structure, for example, even if a great impact (acceleration) acts on the laser printer 1 during transportation and a great force (inertia force) acts on the front cover 100, the force (inertia force) exerted on the front cover 100 can be received by the hinge mechanism 110 and the protrusion 3B of the housing 3.

Thus, the hinge mechanism 110, especially pins thereof, can be prevented from undergoing a great force, thereby minimizing trouble that is likely to occur during transportation of the laser printer 1, such as damage on the hinge mechanism 110.

The discussion above addresses a color laser printer. However, the features herein may be applied to other printers, such as a monochrome laser printer.

The discussion above addresses a direct tandem-type laser printer. However, the present application is not limited to this type of printer.

As illustrated, the second pressing portion 102 contacts the handle portion 75A of the slider casing 75. However, the contact may be made elsewhere.

As illustrated, the first pressing portion 101 is formed on the feed chute 26 disposed on the front cover 100. However, the portion may be formed elsewhere.

As illustrated, the hinge mechanism 110 includes long holes and pins. However, other hinge mechanisms may be used.

The inclined surface 75E is shown as rounded in the figures. However, the inclined surface 75E may be flat or beveled. Additionally, the first and second planar surfaces are illustrated in FIG. 5 as being substantially perpendicular to one another. These surfaces need not be exactly perpendicular, however, and other angles may be used. For example, the surfaces may form an oblique angle, such as 60°, as illustrated in the example handle 75A in FIG. 1.

While the features herein have been described in connection with various example structures and illustrative aspects, it will be understood by those skilled in the art that other variations and modifications of the structures and aspects described above may be made without departing from the scope of the invention. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus comprising:

a drawer disposed in an apparatus body having an opening on a side, the drawer configured to move horizontally in and out of the apparatus body through the opening, the drawer having an image forming unit;

a cover pivotally disposed on the side of the apparatus body via a hinge and configured to open and close;

a plurality of pressing devices disposed on a side of the cover which faces the drawer and configured to press the drawer in contact therewith as the cover is closed, the pressing devices including a first pressing device disposed in proximity of the hinge and a second pressing device disposed further away from the hinge than the first pressing device, the first pressing device contacting the drawer in advance of the second pressing device as the cover is closed, wherein the first pressing device contacts an end of the drawer located in a horizontal direction substantially perpendicular to a moving direction of the drawer, the drawer is provided with a feed chute configured to create a path where the recording sheet is fed, and the feed chute is disposed on a side of the drawer facing the cover and in a position shifted in the horizontal direction from a position where the first pressing device contacts.

2. The image forming apparatus according to claim 1, wherein the side of the drawer facing the cover includes a first planar surface that is substantially parallel to a moving direction of the drawer unit, a second planar surface that extends in a direction substantially perpendicular to the first planar surface, and an inclined surface that is inclined so as to smoothly connect the first and second planar surfaces, the second pressing device includes a protrusion protruding toward the drawer, and is configured to contact the inclined surface as the cover is closed, and when the opening is closed by the cover, the second pressing device is located inside the apparatus body offset from the second planar surface, and shifted in a direction substantially perpendicular to the first planar surface.

3. The image forming apparatus according to claim 1, wherein the drawer includes a plurality of image forming units.

4. The apparatus of claim 1, wherein one of the pressing devices is configured to make contact with the drawer at a point on the drawer during a closing operation of the cover such that a horizontal force is exerted on the drawer, and to be vertically offset from the point on the drawer when the cover is fully closed.

5. The apparatus of claim 4, wherein the point on the drawer is a rounded corner.

6. The apparatus of claim 4, wherein as a result of the vertical offset when the cover is fully closed, at least one of the pressing devices is supported vertically by the drawer.

7. An image forming apparatus, comprising:

a body having an opening on a side;

a drawer configured to be horizontally removed from the body via the opening; and a cover coupled to the body by a hinge, and placed to cover the opening when in a closed position, the cover including first and second protrusions extending inward toward the body from the cover when the cover is in a closed position, the first protrusion being closer to the hinge than the second, the first protrusion being longer than the second protrusion, and the protrusions being placed to make sequential contact with the drawer as the cover is closed, wherein one of the protrusions is configured to make contact with the drawer at a point on the drawer during a closing operation of the cover such that a horizontal force is exerted on the drawer, and to be vertically offset from the point on the drawer when the cover is fully closed.

8. The image forming apparatus of claim 7, configured such that one of the protrusions makes contact with a handle of the drawer as the drawer is closed.

9. The apparatus of claim 7, wherein one of the protrusions is configured to contact a point on the drawer during closing of the cover, and the point is adjacent to, in a horizontal direction perpendicular to a direction of motion of the drawer, a feed chute.

10. The apparatus of claim 7, wherein a side of the drawer facing the cover includes a first planar surface that is substantially parallel to a moving direction of the drawer, a second planar surface that is substantially perpendicular to the first planar surface, and an inclined surface that is inclined so as to smoothly connect the first and second planar surfaces, wherein one of the protrusions is positioned to contact the inclined surface during closing of the cover.

* * * * *